US009816303B2

(12) United States Patent
Lee

(10) Patent No.: US 9,816,303 B2
(45) Date of Patent: Nov. 14, 2017

(54) DOUBLE AXIAL HINGE FOR A CONSOLE

(71) Applicant: Harry Kai Lee, Pomona, CA (US)

(72) Inventor: Harry Kai Lee, Pomona, CA (US)

( * ) Notice: Subject to any disclaimer, the term of this patent is extended or adjusted under 35 U.S.C. 154(b) by 0 days.

(21) Appl. No.: 15/072,208

(22) Filed: Mar. 16, 2016

(65) Prior Publication Data

US 2017/0268266 A1 Sep. 21, 2017

(51) Int. Cl.

| | |
|---|---|
| ***E05D 3/12*** | (2006.01) |
| ***E05D 5/02*** | (2006.01) |
| ***E05D 5/06*** | (2006.01) |
| ***E05D 11/06*** | (2006.01) |

(52) U.S. Cl.

CPC ..... *E05D 5/0276* (2013.01); *E05D 3/12* (2013.01); *E05D 5/065* (2013.01); *E05D 11/06* (2013.01); *Y10T 16/547* (2015.01)

(58) Field of Classification Search

CPC .... E05D 3/06; E05D 3/08; E05D 3/12; E05D 11/06; E05D 5/06; E05D 5/065

USPC ..... 16/389, 366, 371, 280

See application file for complete search history.

(56) References Cited

U.S. PATENT DOCUMENTS 54,171 A * 4/1866 Jordan ..... E05D 3/02 16/389
79,950 A * 7/1868 Carkeet ..... E05D 3/12 16/343
378,861 A * 3/1888 Atwood ..... E05D 3/12 16/366
428,402 A * 5/1890 Morris ..... E05D 3/12 16/366
498,564 A * 5/1893 Morris ..... E05D 3/12 16/354
620,512 A * 2/1899 Terry ..... B65D 9/14 16/371
894,998 A * 8/1908 Backus ..... B65F 1/1646 126/194
975,131 A * 11/1910 Hauer ..... E05D 3/12 16/371
1,031,745 A * 7/1912 Unckrich ..... E05D 3/12 16/366
1,098,634 A * 6/1914 Neighbors ..... E05D 3/02 16/389
1,144,404 A * 6/1915 Williams ..... E05D 1/06 16/260

(Continued)

*Primary Examiner* — Jeffrey O Brien
(74) *Attorney, Agent, or Firm* — Tommy SF Wang; Wang IP Law Group, P.C.

(57) ABSTRACT

A double axial hinge for a console creates myriad combinations of folding, opening, closing, and extending of doors, panels, and windows of a console. The hinge provides a fixed central panel having a pair of edges. A first pivoting axis and a second pivoting axis in a parallel, spaced-apart relationship enable pivoting about the central panel up to 360 degrees from two directions. The ends of the hinge utilize a first L-shaped bracket and second L-shaped bracket that pivot independently of each other and have a broad L-shape that can be mounted on various mounting surfaces. The L-shaped brackets have a mounting panel that mounts to the console and a hinging panel that pivots about the respective pivoting axes. In an alternative embodiment of the hinge, at least one tab extends from the second pivoting axis restricts pivoting in a first direction about a central panel beyond 90 degrees.

14 Claims, 15 Drawing Sheets

(56) References Cited

U.S. PATENT DOCUMENTS 1,155,161 A * 9/1915 Ramsey ..... E05D 15/30 16/366
1,429,527 A * 9/1922 Paul ..... E05D 3/02 16/389
1,455,550 A * 5/1923 Rodell ..... E05D 11/06 16/375
1,456,574 A * 5/1923 Roberts ..... A47B 3/0818 108/131
1,470,429 A * 10/1923 Dunbar ..... A47F 5/05 16/366
1,529,725 A * 3/1925 Sosa ..... E05D 3/00 16/281
1,534,467 A * 4/1925 Shea, Jr. ..... E05D 3/00 16/262
1,560,850 A * 11/1925 Polack ..... E06B 3/50 16/362
1,735,696 A * 11/1929 Ridley ..... E05D 3/12 16/371
1,757,811 A * 5/1930 Packer ..... E05D 3/12 312/7.1
1,776,464 A * 9/1930 Blackman ..... A47B 67/02 16/371
1,821,136 A * 9/1931 Bolakowski ..... E05D 3/12 126/194
1,875,922 A * 9/1932 Harbert ..... B61D 17/10 16/366
1,927,828 A * 9/1933 Greenhill ..... E04H 3/08 16/371
2,000,474 A * 5/1935 O'Connor ..... B61D 7/18 16/235
2,070,511 A * 2/1937 Clements ..... F25D 25/00 16/366
2,181,342 A * 11/1939 Reid ..... B62D 33/0273 16/366
2,200,277 A * 5/1940 Howie ..... B62D 33/04 16/366
2,205,484 A * 6/1940 Lindsay ..... E05D 3/12 16/350
2,236,400 A * 3/1941 Follmer ..... A47B 1/00 108/63
2,277,176 A * 3/1942 Wagner ..... E05D 3/12 16/366
2,297,629 A * 9/1942 Meyer ..... A47G 5/00 16/366
2,325,182 A * 7/1943 Fitzpatrick ..... E05D 3/12 108/169
2,359,554 A * 10/1944 Griswold ..... B64C 25/26 16/371
2,372,431 A * 3/1945 Kahle ..... E05D 3/12 16/371
2,433,305 A * 12/1947 Talcott, Jr. ..... E05D 3/12 16/371
2,440,817 A * 5/1948 Benson ..... E05D 3/12 16/302
2,624,067 A * 1/1953 Tassell ..... E05D 5/065 16/389
2,803,850 A * 8/1957 Hooper ..... E05D 11/06 16/341
3,102,583 A * 9/1963 Rowe ..... E05D 15/165 16/104
3,439,377 A * 4/1969 Bucholz ..... E05D 5/065 16/389
3,591,247 A * 7/1971 Berry ..... E05D 7/12 16/382
3,832,756 A * 9/1974 Lew ..... E05D 3/12 16/297
3,999,246 A * 12/1976 Suska ..... E05D 5/14 16/273
4,242,773 A * 1/1981 Beigh ..... E05D 3/12 16/371
4,309,792 A * 1/1982 Faye ..... E04D 13/076 16/385
4,486,919 A * 12/1984 Schoenke ..... E05D 3/12 16/366
4,684,017 A * 8/1987 Watanabe ..... A45D 33/22 16/265
4,928,350 A * 5/1990 Morgan ..... E05D 3/12 16/297
5,282,293 A * 2/1994 Pedoeem ..... E05D 3/12 16/342
5,355,559 A * 10/1994 Bowers ..... E05D 5/065 16/384
5,493,760 A * 2/1996 Takimoto ..... E05D 3/12 16/366
5,570,917 A * 11/1996 Cutrer ..... E05B 15/0205 16/392
5,588,180 A * 12/1996 Chester ..... A47B 3/12 16/225
5,882,098 A * 3/1999 Brown ..... A47B 3/08 108/179
5,943,739 A * 8/1999 Vandergriff ..... E05D 3/12 16/221
6,389,644 B1 * 5/2002 Russo ..... E05D 5/06 16/254
6,807,710 B2 * 10/2004 Abbott ..... E05D 3/12 16/221
7,765,644 B2 * 8/2010 Ueyama ..... G06F 1/1616 16/354
7,814,621 B1 * 10/2010 Radke ..... E05D 11/1014 16/230
7,832,056 B2 * 11/2010 Kuwajima ..... H04M 1/022 16/282
7,832,057 B2 * 11/2010 Hoffman ..... E05D 3/06 16/287
7,900,323 B2 * 3/2011 Lin ..... F21S 6/003 16/254
7,908,711 B2 * 3/2011 Johnson ..... A47G 25/06 16/366
8,296,905 B2 * 10/2012 Zhang ..... G06F 1/1681 16/330
2004/0034966 A1 * 2/2004 Wegman ..... E05D 5/06 16/254
2004/0034969 A1 * 2/2004 Wegman ..... E05D 5/06 16/389
2005/0055807 A1 * 3/2005 Maatta ..... G06F 1/1616 16/366
2005/0204510 A1 * 9/2005 Heimann ..... D06F 58/04 16/366
2006/0059662 A1 * 3/2006 Roeper ..... E05D 5/06 16/382
2008/0127565 A1 * 6/2008 Taylor ..... E05D 5/06 49/394
2010/0213317 A1 * 8/2010 Wagner ..... E05D 3/08 244/129.5
2010/0269302 A1 * 10/2010 Jagannathan ..... E05D 11/06 16/374
2012/0023706 A1 * 2/2012 Fuller ..... E05D 11/06 16/374
2013/0219664 A1 * 8/2013 Burda ..... E05D 11/06 16/374

* cited by examiner

DOUBLE AXIAL HINGE FOR A CONSOLE

FIELD OF THE INVENTION

The present invention relates generally to a double axial hinge for a console. More so, a double jointed hinge creates myriad folding, closing, opening, extending, retracting combinations for a console by providing a central panel having a pair of outer edges; whereby two pivoting axes are arranged in a parallel, spaced-apart relationship at the outer edges of the central panel and are configured to enable pivoting about the central panel at between 0° to 360°; whereby a first L-shaped bracket is disposed in axial alignment with a first one of the pivoting axes; whereby a second L-shaped bracket is disposed in axial alignment with a second one of the pivoting axes; whereby each L-shaped bracket may join with a door, panel, or window of a console and enable between 0° to 360° rotation thereof.

BACKGROUND OF THE INVENTION

Typically, a hinge is a mechanical bearing that connects two solid objects, typically allowing only a limited angle of rotation between them. Two objects connected by an ideal hinge rotate relative to each other about a fixed axis of rotation. Hinges may be made of flexible material or of moving components.

A variety of hinge, latch, and hinge and latch devices exist that can be used to allow for the opening and/or closing of console or cabinet doors and other pivoting and/or latch type devices. Some such devices only allow for the door or other pivoting device to only be opened in a single direction. Other devices allow for the door or other pivoting device to be operated in two different directions.

Generally, over the years, a number of hinge devices have been developed for the purpose of permitting the opening and closing of the doors of console furniture and other cabinets from either the left or right side of the console or cabinet. Early embodiments of this concept enabled a person to select the side of the console or cabinet that would serve as a pivot axis. Thereafter, unless the hardware were altered, the door would open from that side. When it became necessary to change the hinge side, a screwdriver, wrench and other tools were needed to mechanically transfer the pivot axis from one side to the other.

More recent modifications have utilized a combination of springs and latches to allow the door to be opened alternatively from the left or from the right. This design consists of a double sided removable axle arrangement that permits the door to be opened from one of the two sides. In order to prevent an unintentional opening of the door, a locking mechanism is provided for each axle arrangement. This mechanism has to be released by the user by activating an opening button prior to opening the door. This locking mechanism consists of a multitude of elements which when in the closed position are interlocked. As soon as one of the locking mechanisms is released on one side of the door, the door could then be rotated around the closed axle arrangement whereby a cam slides into a curved guide while at the same time the central opening in the door area of the locking mechanism blocks and the release button is locked.

Other proposals have involved double sided hinges that open and close a door from multiple sides. The problem with these devices is that they do not provide a full 360° of pivoting rotational motion for the various doors, panels, and windows of a console. Thus, an unaddressed need exists in the industry to address the aforementioned deficiencies and inadequacies. Even though the above cited methods for furniture hinges meets some of the needs of the market, a double axial hinge that hingedly fastens to a mounting surface, such as a console, and specifically the doors, panels, and windows of a console, and enables multiple combinations of opening, closing, and folding of the doors, panels, and windows of the console between 0° to 360° is still desired.

SUMMARY OF THE INVENTION

The present invention is directed to a double axial hinge that hingedly fastens to a mounting surface, such as a console, and specifically the doors, panels, and windows of a console. The double axial hinge is configured to enable multiple combinations of opening, closing, and folding of the doors, panels, and windows of the console. The double axial hinge enables rotation of the doors, panels, and windows between 0° to 360°. In this manner, the door, panel, or window may be rotated into multiple open and close positions, from a left side, a right side, a top side, and a bottom side, and in multiple folding configurations relative to the fixed components of the of the console.

One aspect of a double axial hinge, comprises:

- a central panel, the central panel defined by a pair of edges and at least one central aperture, the at least one central aperture configured to enable mounting of the central panel;
- a first pivoting axis, the first pivoting axis configured to join with one edge of the central panel, the first pivoting axis further configured to enable pivoting about the central panel at about between 0° to 360°;
- a second pivoting axis, the second pivoting axis configured to join with one edge of the central panel, the second pivoting axis further configured to enable pivoting about the central panel at about between 0° to 360° while pivoting in a second direction, the second pivoting axis further configured to restrict pivoting of the central panel to 90° while pivoting in a first direction;
- a first L-shaped bracket, the first L-shaped bracket defined by a first hinging panel and a first mounting panel disposed in a generally perpendicular relationship, the first hinging panel configured to join with the first pivoting axis, whereby the first L-shaped bracket is configured to pivot between 0° to 360° relative to the central panel;
- a second L-shaped bracket, the second L-shaped bracket defined by a second hinging panel and a second mounting panel disposed in a generally perpendicular relationship, the second hinging panel configured to join with the second pivoting axis, whereby the second L-shaped bracket is configured to pivot between 0° to 360° relative to the central panel; and
- at least one tab, the at least one tab configured to join with the second pivoting axis, the at least one tab configured to restrict pivoting of the central panel to 90° while pivoting in a first direction towards the second L-shaped bracket, whereby when the central panel pivots towards the second L-shaped bracket, the at least one tab extending from the second pivoting axis engages the second hinging panel at 90°.

In another aspect, the central panel is generally rectangular in shape.

In another aspect, the hinge is fabricated from metal.

In another aspect, the central panel, the first mounting panel, and the second mounting panel are configured to mount on a mounting surface.

In another aspect, the mounting surface comprises a door, panel, or window of a console.

In another aspect, the first pivoting axis comprises a first hinge rod and a first hinge interlock.

In another aspect, the second pivoting axis comprises a second hinge rod and a second hinge interlock.

In another aspect, the first mounting panel and the second mounting panel orient in the same direction when the first L-shaped bracket and the second L-shaped bracket are coplanar.

In another aspect, the at least one tab is disposed to orient in the opposite direction than the second mounting panel.

In another aspect, the at least one tab comprises two spaced-apart tabs.

In some embodiments, the double axial hinge may include a central panel having a pair of edges. The central panel may have a generally rectangular shape, and further include at least one central aperture for enabling fastening to the mounting surface, such as the door, panel, or window of the console.

In some embodiments, a first pivoting axis and a second pivoting axis are arranged in a parallel, spaced-apart relationship at the edges of the central panel. The pivoting axes are configured to enable pivoting about the central panel at about between 0° to 360° in a first and second direction. This wide range of pivoting from two sides creates great flexibility for opening, closing, and folding of the doors, panels, and windows of the console.

In some embodiments, a first L-shaped bracket is disposed in axial alignment with the first pivoting axis. The first L-shaped bracket is defined by a first hinging panel that forms a generally perpendicular junction with a first mounting panel. The first mounting panel, having at least one first aperture, is configured to fixedly fasten to the mounting surface. The first hinging panel is configured to join with the first pivoting axis. In this manner, the entire first L-shaped bracket may pivot between 0° to 360° about the central panel.

In one embodiment, the orientation of the first L-shaped bracket is described as such: the first hinging panel lies coplanar to the central panel at 0° and 360° relative to the central panel. Additionally, the first L-shaped bracket may include at least one first aperture for enabling fastening to the mounting surface, such as the door, panel, or window of the console.

In some embodiments, a second L-shaped bracket is disposed in axial alignment with the second pivoting axis. The first L-shaped bracket is defined by a second hinging panel that forms a generally perpendicular junction with a second mounting panel. The second mounting panel, having at least one second aperture, is configured to fixedly fasten to the mounting surface. The second hinging panel is configured to join with the second pivoting axis. In this manner, the entire second L-shaped bracket may pivot between 0° to 360° about the central panel, and the first L-shaped bracket.

In one embodiment, the orientation of the second L-shaped bracket is described as such: the second hinging panel lies coplanar to the central panel at 0° and 360° relative to the central panel. Also, when the first and second L-shaped brackets are coplanar, the first and second mounting panels are oriented in the same direction. Additionally, the second L-shaped bracket may include at least one second aperture for enabling fastening to the mounting surface, such as the door, panel, or window of the console.

In one alternative embodiment, the second pivoting axis comprises at least one tab. The at least one tab is disposed to orient in the opposite direction than the second mounting panels. The tab is configured to restrict rotation of the central panel to 90° while pivoting in a first direction towards the second L-shaped bracket. This is because when the central panel pivots towards the second L-shaped bracket, the tab extending from the second pivoting axis, engages the second hinging panel at 90° . The second hinging panel, thus acts as a barrier to pivoting by the central panel beyond 90°.

One objective of the present invention is to provide a double axial hinge that hingedly fastens to a mounting surface, such as a console, and specifically the doors, panels, and windows of a console.

Another objective is to create myriad combinations of folding, opening, closing, and extending of doors, panels, and windows of a console.

Another objective is to provide independent pivoting from two opposite sides of a hinge.

Yet another objective is to provide at least one tab that restricts pivoting in a first direction to 90°.

Yet another objective is to provide a durable, multipurpose double axial hinge.

Yet another objective is to provide cost effective hinging mechanism for a console.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which:

FIG. 5A shows the first and second L-shaped brackets disposed coplanar to each other, FIG. 5B shows the central panel and the first L-shaped bracket pivoting about the second pivoting axis in a first direction, FIG. 5C shows the central panel restricted from additional pivoting after 90°, and FIG. 5D illustrates the first L-shaped bracket continue to pivot, FIG. 5E illustrates a first hinging panel of the first L-shaped bracket engaging a second mounting panel of the second L-shaped bracket, and FIG. 5F illustrates the first L-shaped panel pivoting in a second direction, in accordance with an embodiment of the present invention;

FIG. 7A shows the first and second L-shaped brackets disposed coplanar to each other, FIG. 7B shows the central panel and the first L-shaped bracket pivoting about the second pivoting axis in a first direction, FIG. 7C shows the central panel and the first L-shaped bracket continue to pivot about the second pivoting axis in a first direction, FIG. 7D shows the central panel restricted from additional pivoting after 90°, and FIG. 7E illustrates the first L-shaped bracket continue to pivot, in accordance with an embodiment of the present invention;

FIG. 8A shows the second L-shaped bracket fully engaged on the first L-shaped at 180° bracket to bring two panels together, in accordance with an embodiment of the present invention;

FIG. 21 illustrates the buckle assembly, and FIG. 21B illustrates two buckle assemblies at the corners of the console door, in accordance with an embodiment of the present invention.

Like reference numerals refer to like parts throughout the various views of the drawings.

DETAILED DESCRIPTION OF THE INVENTION

Figure 1:
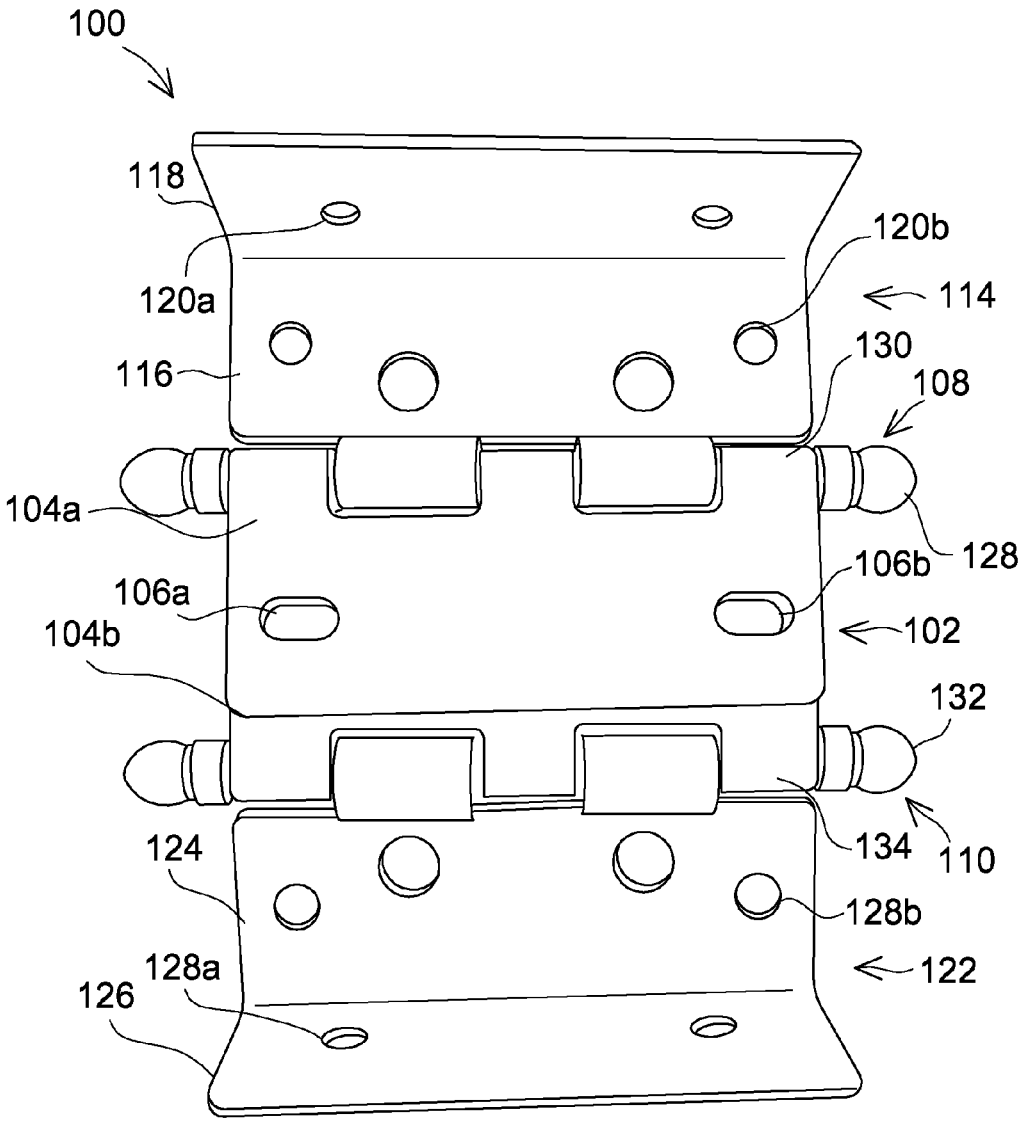
FIG. 1 illustrates a top pan view of an exemplary double axial hinge, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "first," "second," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112.

In one embodiment of the present invention presented in FIGS. 1-21B, a double axial hinge 100 creates myriad combinations of folding, opening, closing, and extending of doors, panels, and windows of a mounting surface. The mounting surface may include, without limitation, a console, a cabinet, a door, a panel, a window, a drawer, a chest, a tool box, and a machine. The double axial hinge 100, hereafter "hinge 100", is unique in that it provides a central panel 102. A first pivoting axis 108 and a second pivoting axis 110 disposed in a parallel, spaced-apart relationship enable pivoting about the central panel 102 up to 360° from two directions.

Further, the hinge 100 provides a first L-shaped bracket 114 and a second L-shaped bracket 122 that pivot independently of each other about their respective pivoting axes 108, 110. The L-shaped brackets 114, 122 have broad L-shaped mounting panels 118, 126 that can be mounted on various mounting surfaces. In yet another unique configuration of the hinge 100, at least one tab 112*a*, 112*b* extends from the second pivoting axis 110 to restrict pivoting about the central panel 102 in a first direction to 90°. Conversely, the tab 112*a*, 112*b* may extend from the first pivoting axis 108 to restrict pivoting about the central panel 102 in a second direction to 90°. This 90° restrictive configuration of the hinge 100 provides even greater amount of hinging combinations that can be applied on the mounting surface.

Thus in one exemplary use of the hinge 100, it is possible for a console door, a cabinet door, a window, or a refrigerator door to be opened or closed from either of two sides without the necessity of making mechanical changes in the configuration of either hinge, the door, or the cabinet. Further, the console door, cabinet door, window, or refrigerator door can be expanded or compressed relative to the body of the console, cabinet, window pane, or refrigerator, respectively. In another exemplary use, multiple pivoting motions in multiple directions may be possible for each console door, cabinet door, window pane, or refrigerator door in relation to the body of the console, cabinet, or refrigerator. In yet another exemplary use, multiple hinges work together along one side of a double-hinged console or cabinet door.

As illustrated in FIG. 1, the hinge 100 comprises a fixed central panel 102 having a pair of edges 104*a*, 104*b*. The central panel 102 may have a generally rectangular shape. The central panel 102 may be constructed from a rigid metal material to withstand the strain of supporting doors, windows, and panels. In some embodiments, the central panel 102 may include at least one central aperture 106*a*, 106*b* for enabling fastening to the mounting surface, such as the door, panel, or window of the console. In one embodiment, a fastener, such as a screw may pass through the central aperture 106*a*, 106*b* to fix the central panel 102 in the mounting surface. The central aperture 106*a*, 106*b* may have a generally circular or oval shape.

Figure 2:
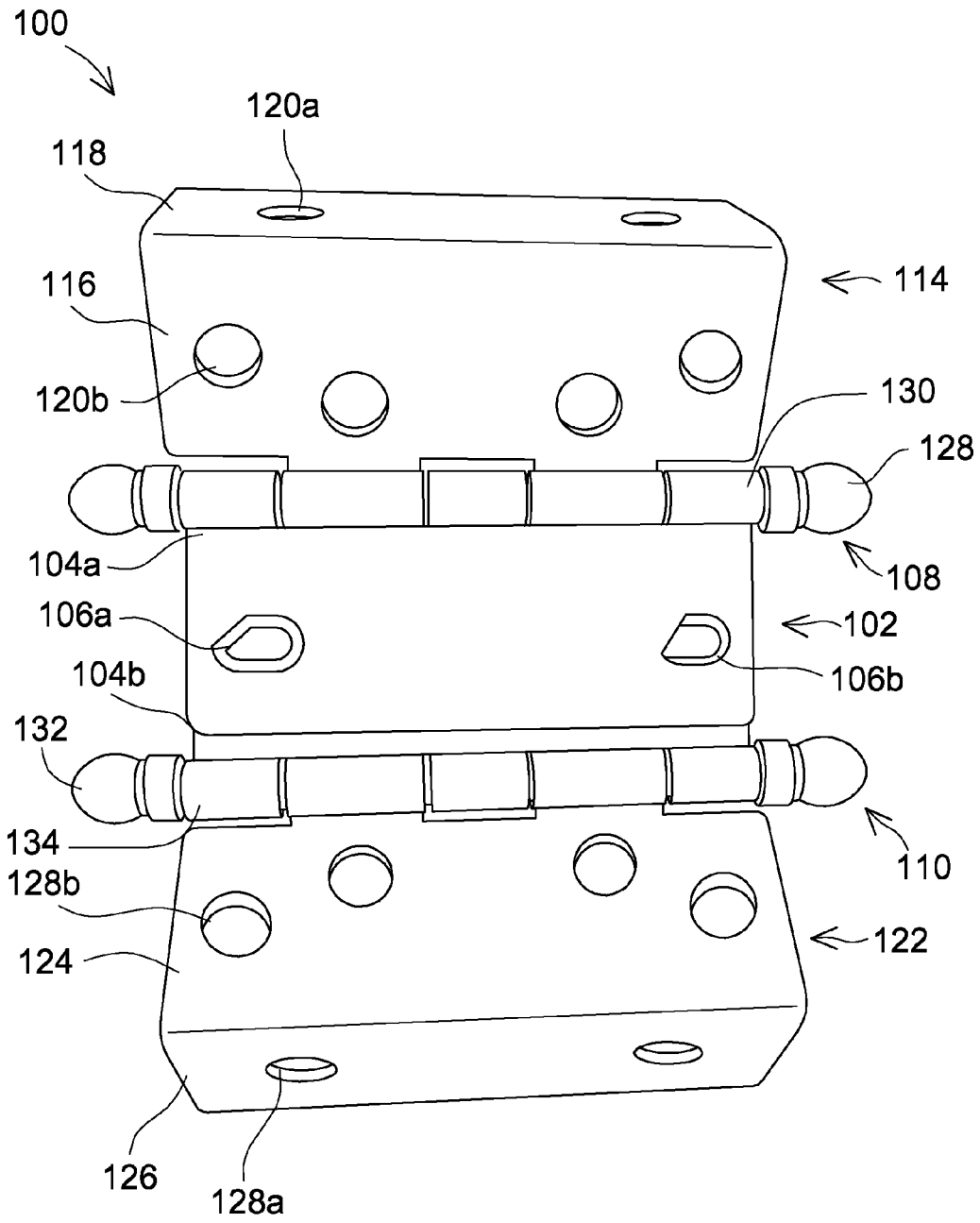
FIG. 2 illustrates a bottom pan view of a double axial hinge, in accordance with an embodiment of the present invention.

Turning now to FIG. 2, a first pivoting axis 108 and a second pivoting axis 110 are arranged in a parallel, spaced-apart relationship at the edges 104*a*, 104*b* of the central panel 102. The pivoting axes 108, 110 are configured to enable pivoting about the central panel 102 at about between 0° to 360° in a first direction and a second direction. This wide range of pivoting from two sides creates great flexibility for opening, closing, and folding of the doors, panels, and windows of the console. In one embodiment, the first pivoting axis 108 comprises a first hinge rod 128 that passes through a first hinge interlock 130. Similarly, the second pivoting axis 110 comprises a second hinge rod 132 that passes through a second hinge interlock 134.

In some embodiments, a first L-shaped bracket 114 is disposed in axial alignment with the first pivoting axis 108. The first L-shaped bracket 114 is defined by a first hinging panel 116 that forms a generally perpendicular junction with a first mounting panel 118. The first mounting panel 118 may include at least one first aperture 120*a*, 120*b* that is configured to fixedly fasten to the mounting surface. The first hinging panel 116 is configured to join with the first pivoting axis 108 and pivot about the central panel 102. In this manner, the entire first L-shaped bracket 114 may pivot between 0° to 360° about the central panel 102.

In one embodiment, the orientation of the first L-shaped bracket 114 is described as such: the first hinging panel 116 lies coplanar to the central panel 102 at 0° and at 360° relative to the central panel 102. Additionally, the first L-shaped bracket 114 may include at least one first aperture 120*a*, 120*b* for enabling fastening to the mounting surface, such as the door, panel, or window of the console. In one embodiment, a fastener, such as a screw may pass through the first aperture 120*a*, 120*b* to fix the central panel 102 in the mounting surface. The first aperture 120*a*, 120*b* may have a generally circular or oval shape.

In some embodiments, a second L-shaped bracket 122 is disposed in axial alignment with the second pivoting axis 110. The second L-shaped bracket 122 is defined by a second hinging panel 124 that forms a generally perpendicular junction with a second mounting panel 126. The second mounting panel 126 may include at least one second aperture 128*a*, 128*b* that is configured to fixedly fasten to the mounting surface. The second hinging panel 124 is configured to join with the second pivoting axis 110 and pivot about the central panel 102. In this manner, the entire second L-shaped bracket 122 may pivot between 0° to 360° about the fixed central panel 102.

Figure 3:
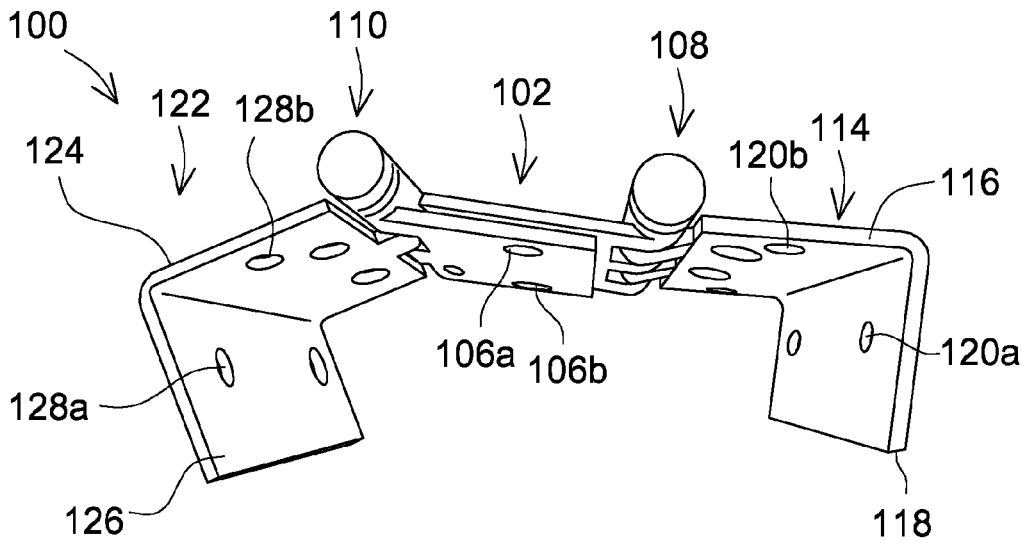
FIG. 3 illustrates an elevated side view of a double axial hinge, in accordance with an embodiment of the present invention.

As FIG. 3 illustrates, the orientation of the second L-shaped bracket 122 is described as such: the second hinging panel 124 lies coplanar to the central panel 102 at 0° and at 360° relative to the central panel 102. Also, when the first and second L-shaped brackets 114, 122 are coplanar, the first and second mounting panels 118, 126 are oriented in the same direction. Additionally, the second L-shaped bracket 122 may include at least one second aperture 128*a*, 128*b* for enabling fastening to the mounting surface, such as the door, panel, or window of the console. In one embodiment, a fastener, such as a screw may pass through the second aperture 128*a*, 128*b* to fix the central panel 102 in the mounting surface. The second aperture 128*a*, 128*b* may have a generally circular or oval shape.

Figure 4:
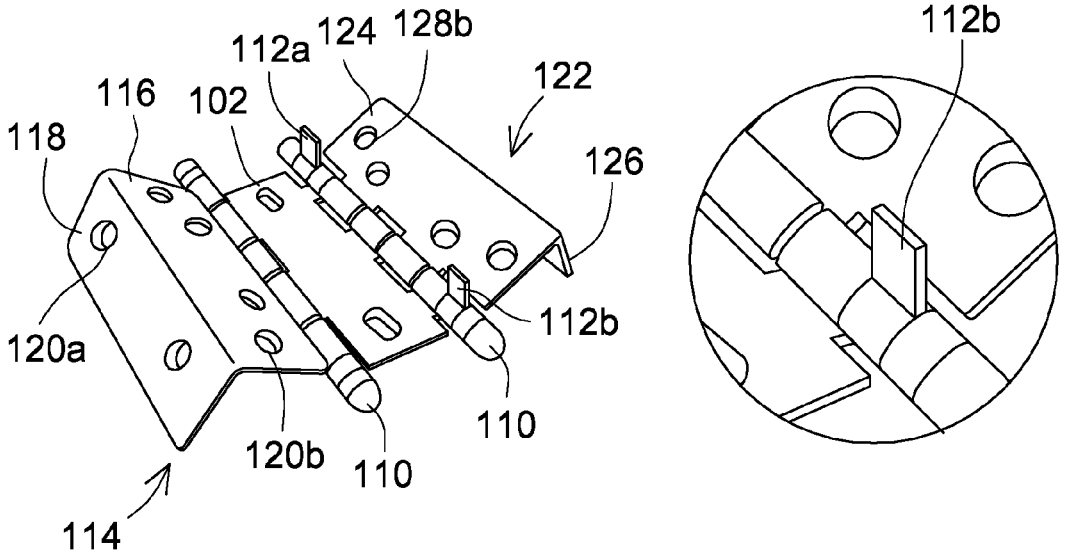
FIG. 4 illustrates an upper angle perspective view of a double axial hinge having at least one tab extending from an exemplary first pivoting axis, in accordance with an embodiment of the present invention.

In one alternative embodiment shown in FIG. 4, at least one tab 112*a*, 112*b* extends from the second pivoting axis 110. The at least one tab 112*a*, 112*b* is disposed to orient in an opposite direction than the second mounting panel 126. The tab 112*a*, 112*b* is configured to restrict rotation of the central panel 102 beyond 90° while the central panel 102 pivots in a first direction towards the second L-shaped bracket 122 (restricted pivoting of central panel 102 illustrated in FIGS. 5D and 6B). This is because when the central panel 102 pivots towards the second L-shaped bracket 122, the tab 112*a*, 112*b*, extending from the second pivoting axis 110, engages the second hinging panel 124 at 90°. The second hinging panel 124, thus acts as a barrier to further pivoting by the central panel 102.

It is also significant to note that the tab 112*a*, 112*b* may also extend from the first pivoting axis 108. This configuration operates in substantially the same manner as described above, except that pivoting in the second direction is restricted by the central panel 102 beyond 90°. Specifically, the tab 112*a*, 112*b* is configured to restrict rotation of the central panel 102 to 90° while pivoting in the second direction towards the first L-shaped bracket 114. This is because when the central panel 102 pivots towards the first L-shaped bracket 114, the tab 112*a*, 112*b* extending from the first pivoting axis 108 engages the first hinging panel 116 at 90°.

Figure 5A:
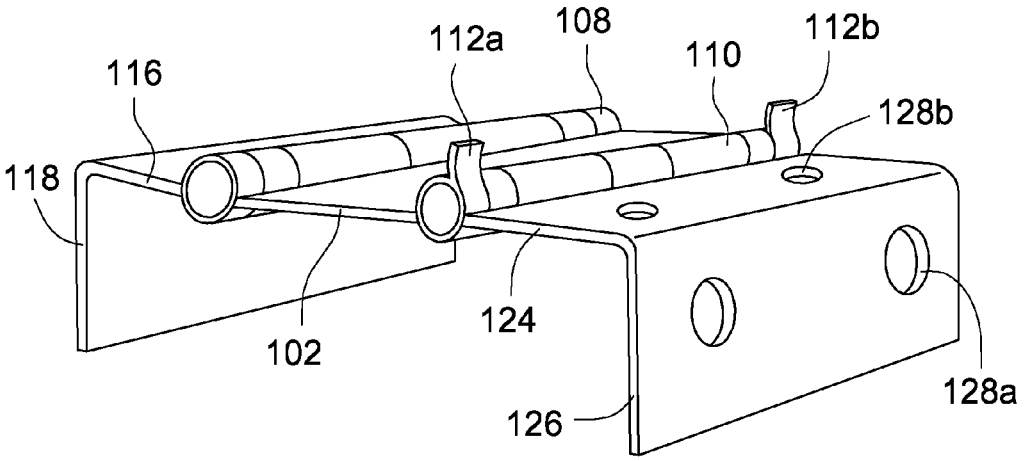
FIGS. 5A, 5B, 5C, 5D, 5E, and 5F illustrate perspective views of a hinge having two tabs that restrict the pivoting motion of a central panel, where
Figure 5B:
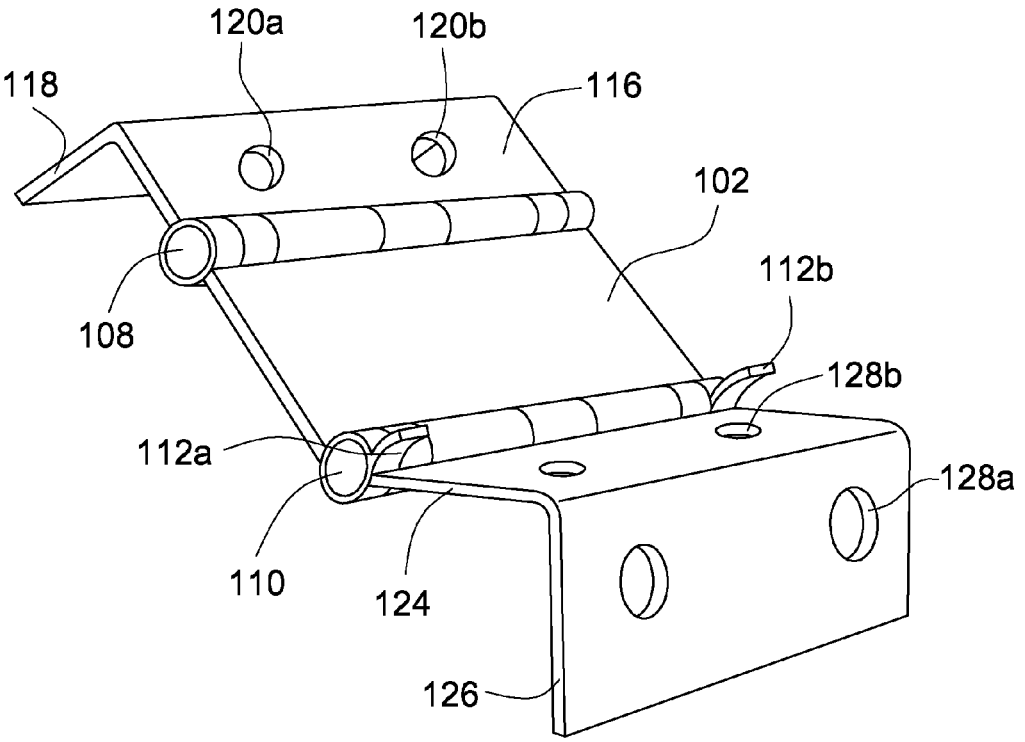
Figure 5C:
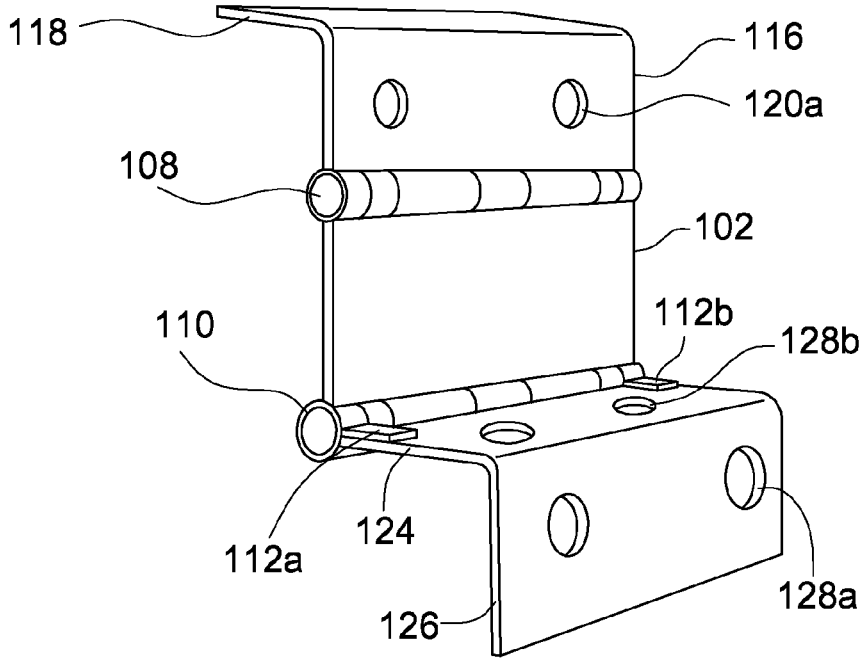

FIGS. 5A-5D illustrate the pivoting restriction that the tab 112*a*, 112*b* creates for the hinge 100. FIG. 5A shows the first and second L-shaped brackets 114, 122 disposed coplanar to each other. FIG. 5B shows the central panel 102 and the first L-shaped bracket 114 pivoting about the second pivoting axis 110 in a first direction. FIG. 5C shows the central panel 102 restricted from additional pivoting after 90°.

Figure 5D:
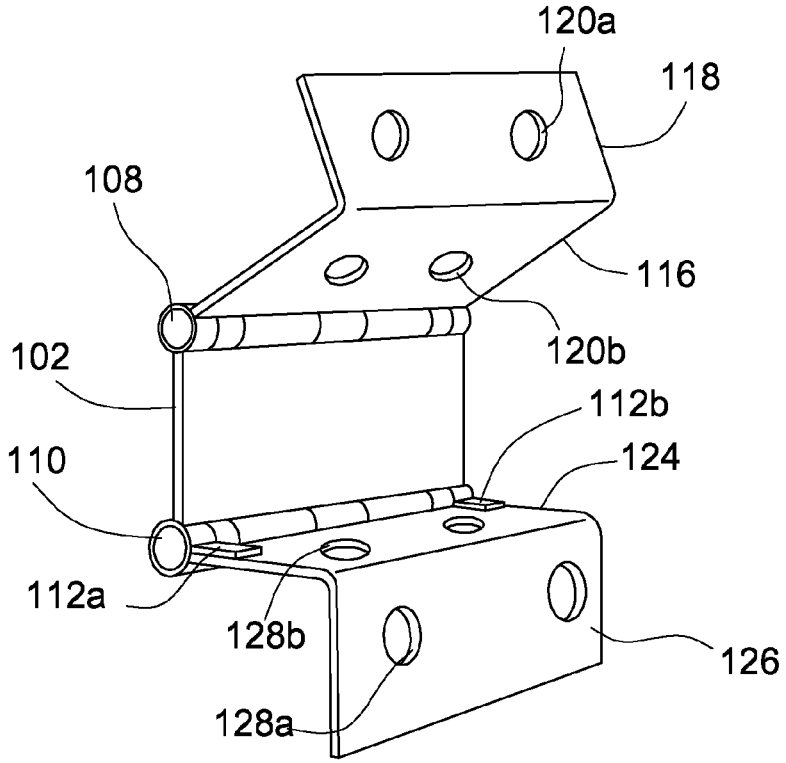
Figure 5E:
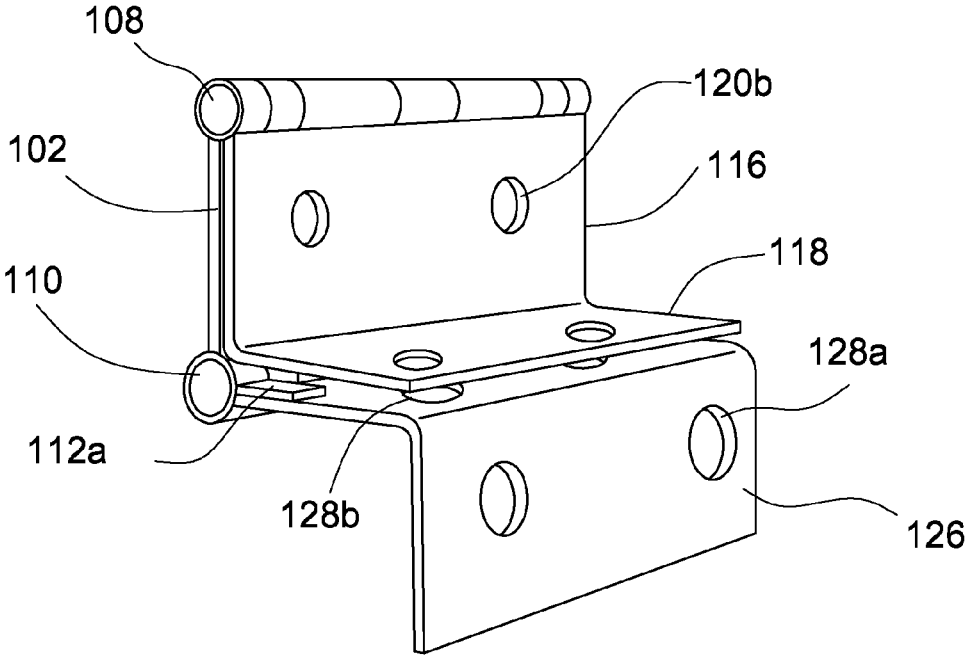
Figure 5F:
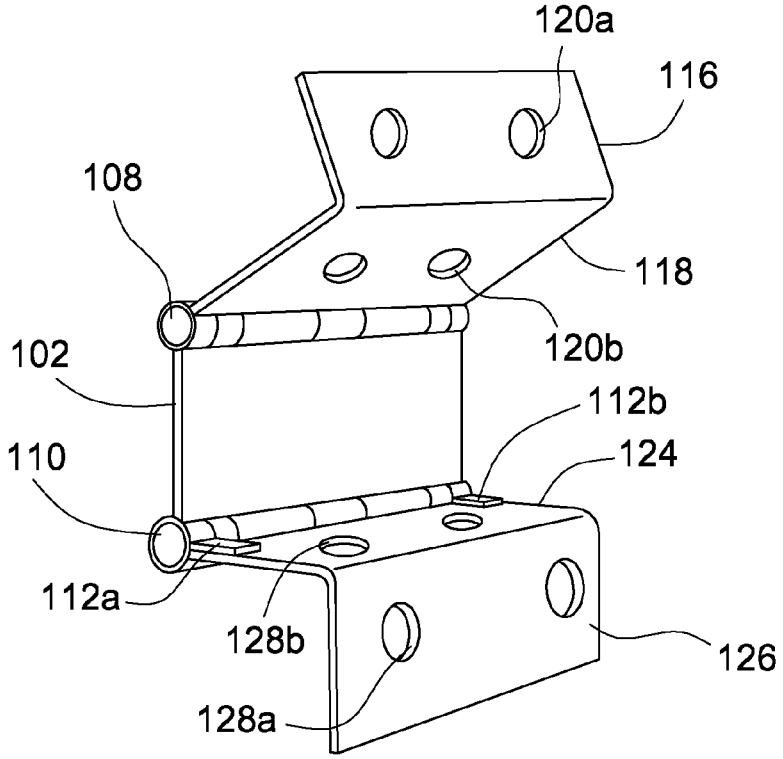

FIG. 5D illustrates that while the central panel 102 cannot pivot in the first direction beyond 90°, the first L-shaped bracket 114 may continue pivoting. This creates additional hinging combinations when the first L-shaped bracket 114 is attached to the mounting surface. FIG. 5E illustrates the first hinging panel 116 of the first L-shaped bracket 114 engaging a second mounting panel 126 of the second L-shaped bracket 122. FIG. 5F illustrates the first L-shaped panel 114 pivoting in a second direction away from the second L-shaped bracket 122.

Figure 6A:
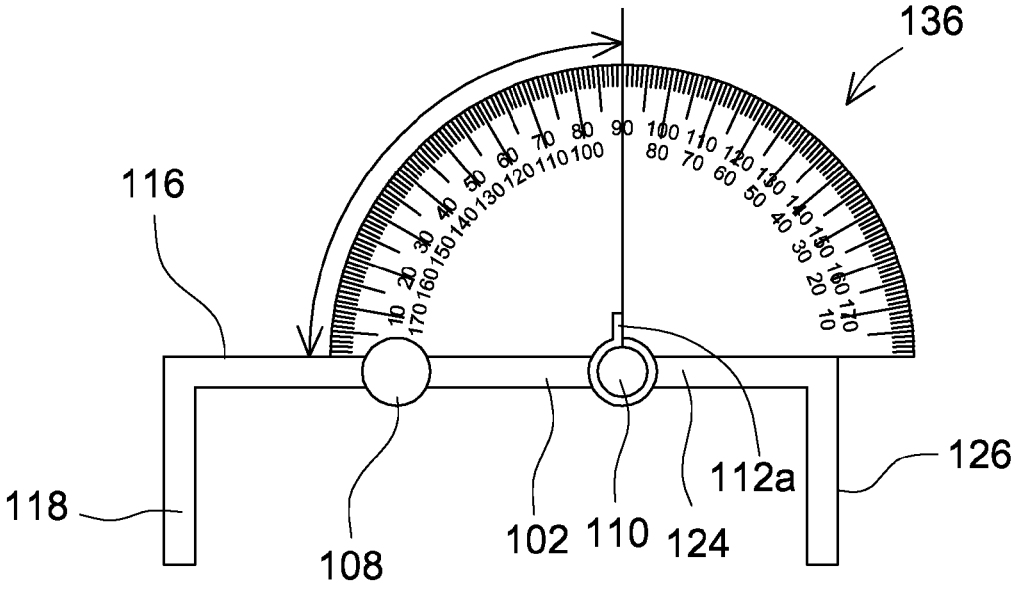
FIGS. 6A and 6B illustrate elevated side views of a hinge in relation to a compass, showing the 90° angle restriction in a first direction by the tab, in accordance with an embodiment of the present invention.
Figure 6B:
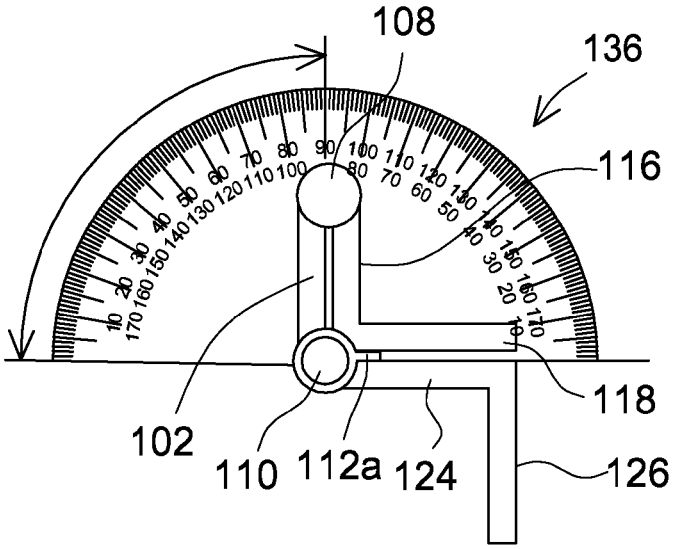

The 90° angle is further illustrated in an elevated side view of FIGS. 6A and 6B, showing the tab 112*a*, 112*b* restricting pivoting motion in the first direction after 90°. The pivoting motion is shown in relation to a compass 136, so as to more fully illustrate the 90° restriction. The compass 136 is held in a position relative to the first L-shaped bracket 114, such that the 90° is clearly depicted.

Figure 7A:
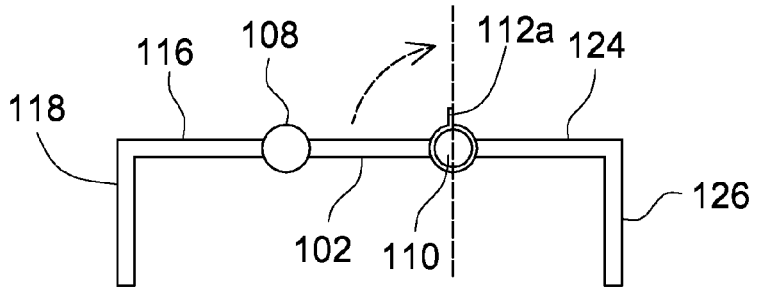
FIGS. 7A, 7B, 7C, 7D, and 7E illustrate elevated side views of a hinge having a tab that restricts the pivoting motion of a central panel, where
Figure 7B:
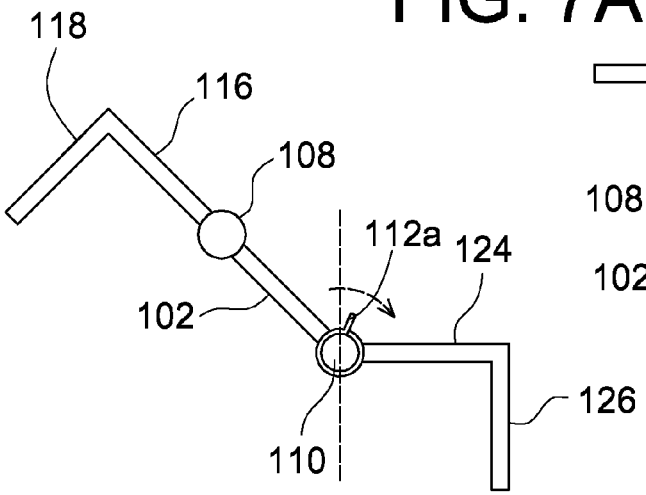
Figure 7C:
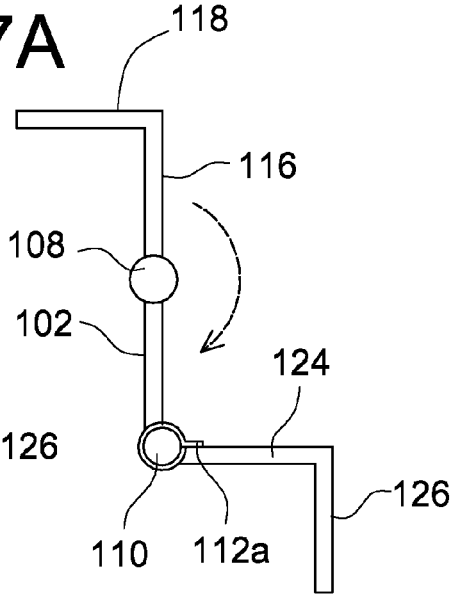
Figure 7D:
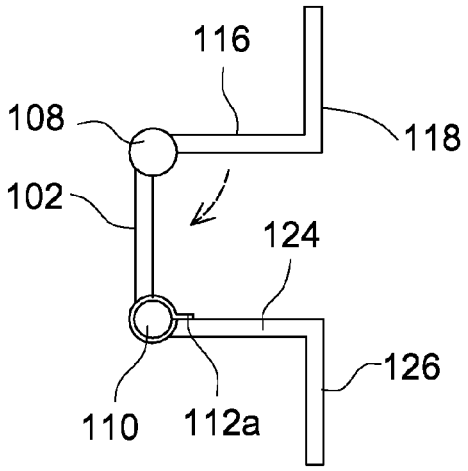
Figure 7E:
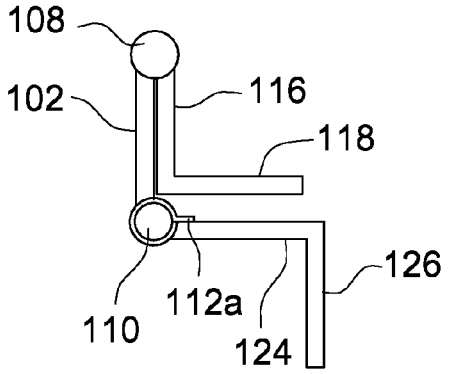

FIGS. 7A-7E provide yet another illustration of the pivoting restriction of the tab 112*a*, 112*b*. FIG. 7A illustrates an elevated side view of the pivoting restriction of the tab 112*a*, 112*b*. FIG. 7A shows the first and second L-shaped brackets 114, 122 disposed coplanar to each other. FIGS. 7B and 7C shows the central panel 102 and the first L-shaped bracket 114 pivoting about the second pivoting axis 110 in a first direction. FIG. 7D shows the central panel 102 restricted from additional pivoting after 90°. FIG. 7E illustrates that while the central panel 102 cannot pivot in the first direction any further, the first L-shaped bracket 114 may continue pivoting until the first mounting panel 118 engages the second hinging panel 124.

Figure 8A:
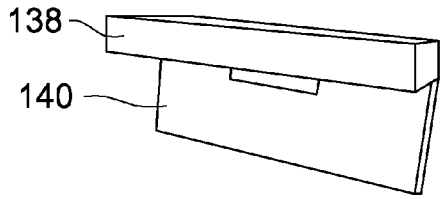
FIGS. 8A and 8B illustrate a perspective view of a hinge, showing a first mounting panel and a second mounting panels for their respective L-shaped brackets, fastened to a mounting surface, where
Figure 8B:
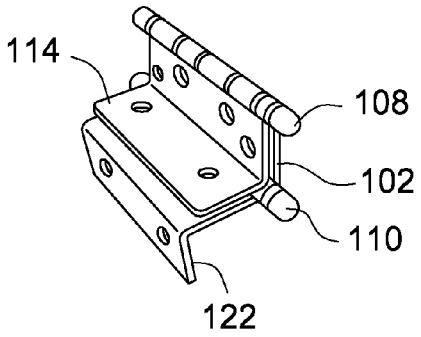
Figure 9A:
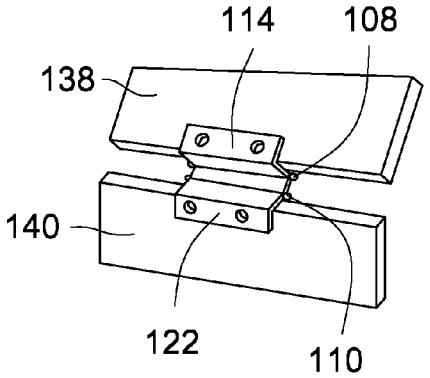
FIGS. 9A and 9B illustrate a perspective view of a hinge, showing the first and second L-shaped brackets separating to expand the attached panels, in accordance with an embodiment of the present invention.
Figure 9B:
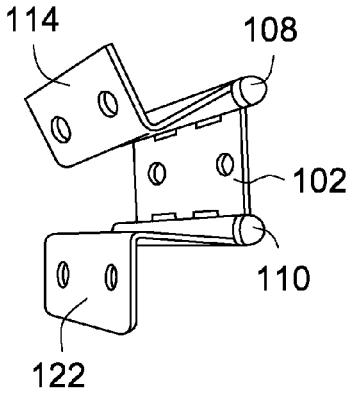
Figure 10A:
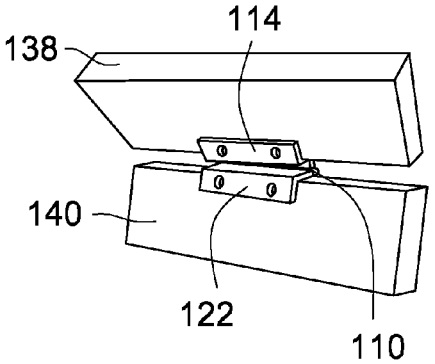
FIGS. 10A and 10B illustrate a perspective view of a hinge, showing the first and second L-shaped brackets coming together to bring the attached panels proximal to each other, in accordance with an embodiment of the present invention.
Figure 10B:
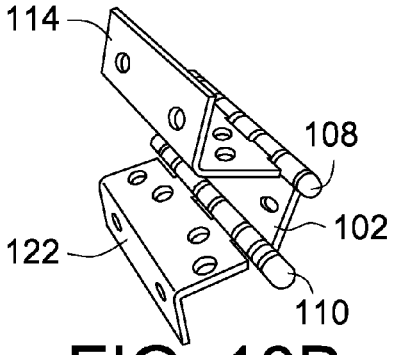

FIGS. 8A and 8B illustrate the hinge 100 with the first and second mounting panels 118, 126 for their respective L-shaped brackets 114, 122, fastened to a first console panel 138 and a second console panel 140, respectively. The console panels 138, 140 may represent a door on a console, cabinet, a window, or a refrigerator door. The first and second panels 138, 140 fold in relation with the pivoting motion of their respective L-shaped brackets 114, 122. FIG. 8A shows the second L-shaped bracket 122 fully engaged on the first L-shaped bracket 114 at 180° to bring the two console panels 138, 140 together. FIGS. 9A and 9B illustrate the first and second L-shaped brackets 114, 122 separating to expand the attached panels 138, 140. Finally, FIGS. 10A and 10B illustrate the first and second L-shaped bracket 114, 122 coming together to bring the attached panels 138, 140 proximal to each other.

Figure 11A:
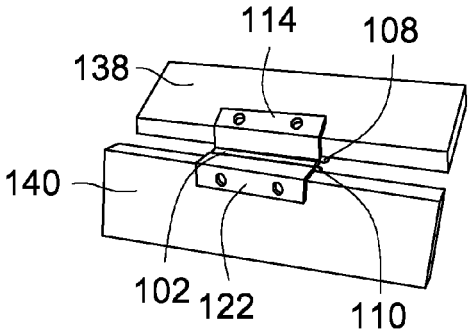
FIGS. 11A and 11B illustrate a perspective view of a hinge, showing the first and second L-shaped brackets pivoting in opposite directions, in accordance with an embodiment of the present invention.
Figure 11B:
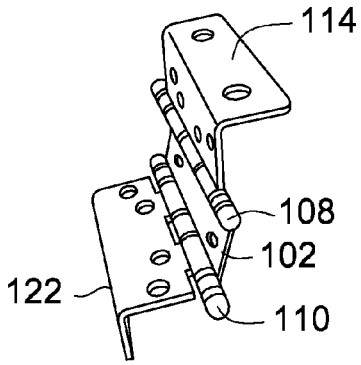
Figure 12A:
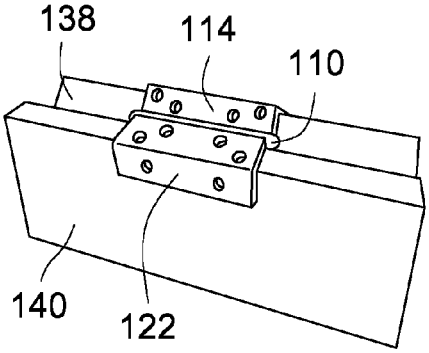
FIGS. 12A and 12B illustrate a perspective view of a hinge, showing the first and second L-shaped brackets almost completely pivoting to 270° in opposite directions, in accordance with an embodiment of the present invention.
Figure 12B:
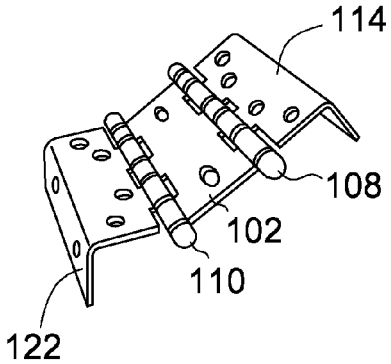
Figure 13A:
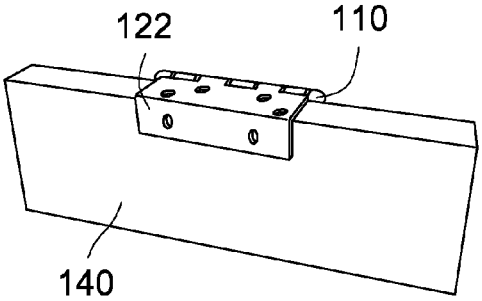
FIGS. 13A and 13B a perspective view of a hinge, showing the first and second L-shaped brackets fully pivoted in opposite directions and their respective attached panels engaged in a coplanar relationship, in accordance with an embodiment of the present invention.
Figure 13B:
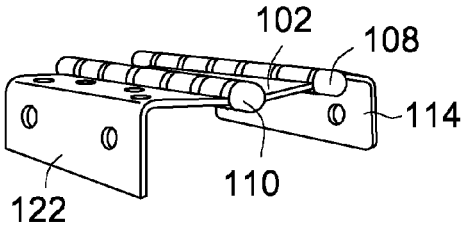

Continuing with the folding exercise of the console panels 138, 140, FIGS. 11A and 11B illustrate the first and second L-shaped brackets 114, 122 pivoting in opposite directions to spread the attached panels 138, 140 further apart. FIGS. 12A and 12B show the first and second L-shaped brackets 114, 122 almost completely pivoting to 270° in opposite directions. Finally, FIGS. 13A and 13B show the first and second L-shaped brackets 114, 122 fully pivoted in opposite directions and their respective attached panels 138, 140 engaged in a coplanar relationship.

Figure 14:
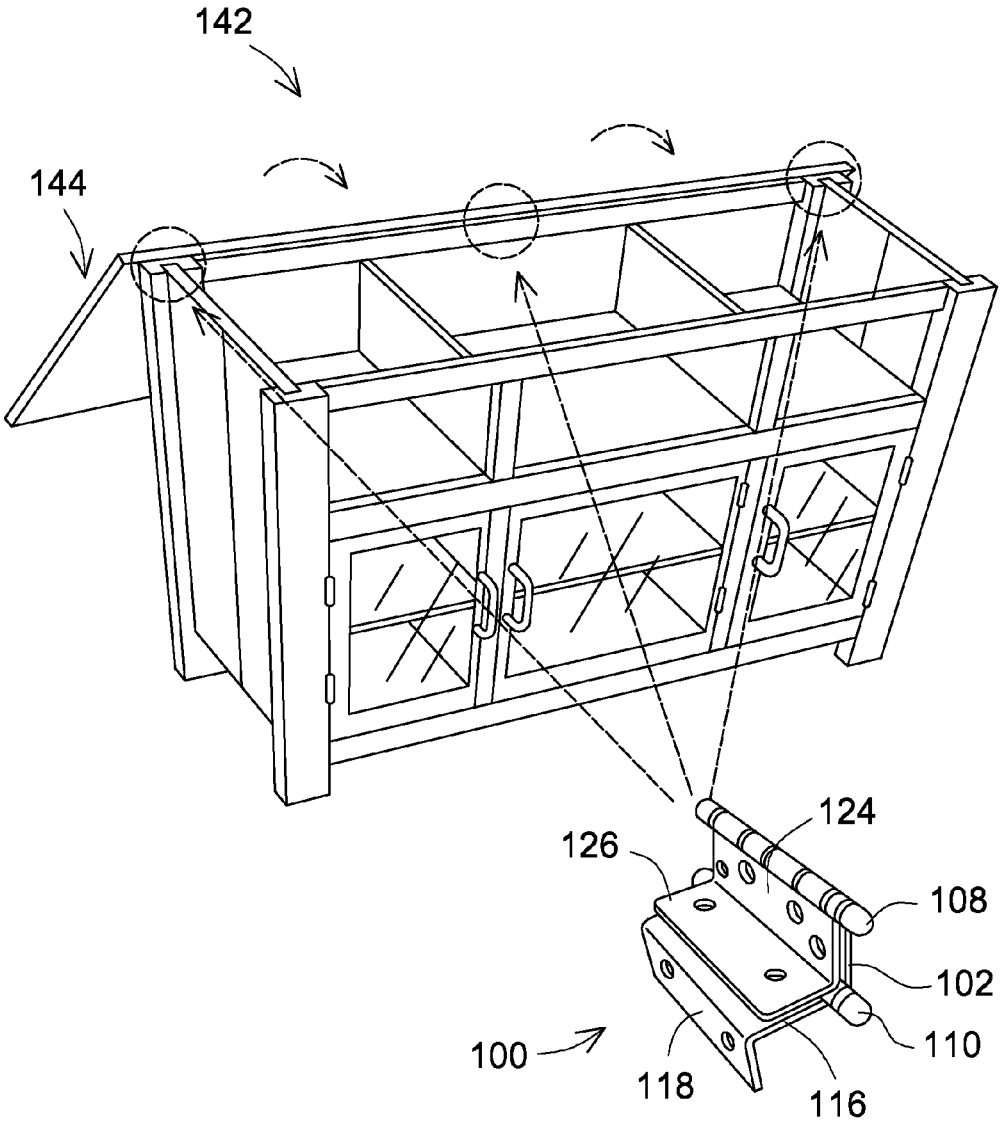
FIG. 14 illustrates a perspective view of a hinge used in a console, showing three hinges are fastened at three spaced-apart locations along the length of a console door, in accordance with an embodiment of the present invention.
Figure 15A:
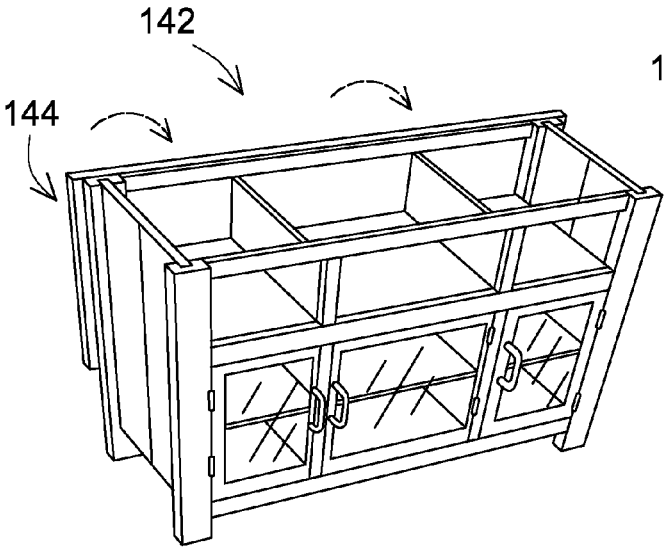
FIGS. 15A and 15B illustrate a perspective view of a hinge in a starting position with the console door fully hinged open, in accordance with an embodiment of the present invention.
Figure 15B:
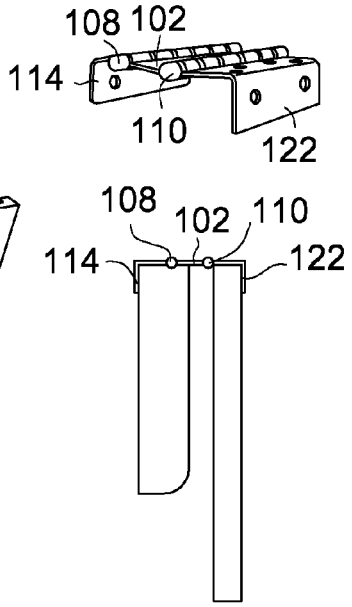

FIG. 14 shows the hinge 100 as operated in a console 142. In this illustration, three hinges are fastened at three spaced-apart locations along the length of a console door 144. The console door 144 hingedly covers the console 142. In this arrangement, the second L-shaped bracket 122 pivots about the central panel 102 up to 270°, so as to enable the console door 144 to pivot from an open position to a fully closed position. FIGS. 15A and 15B illustrate the hinge 100 in a starting position with the console door 144 fully hinged open. The first and second L-shaped brackets 114, 122 are coplanar with each other. It is significant to note that FIG. 15B shows that the hinge 100 is positioned vertically in the console 142. Though, depending on the panel, door, or window, the hinge 100 may also be positioned horizontally in other embodiments.

Figure 16A:
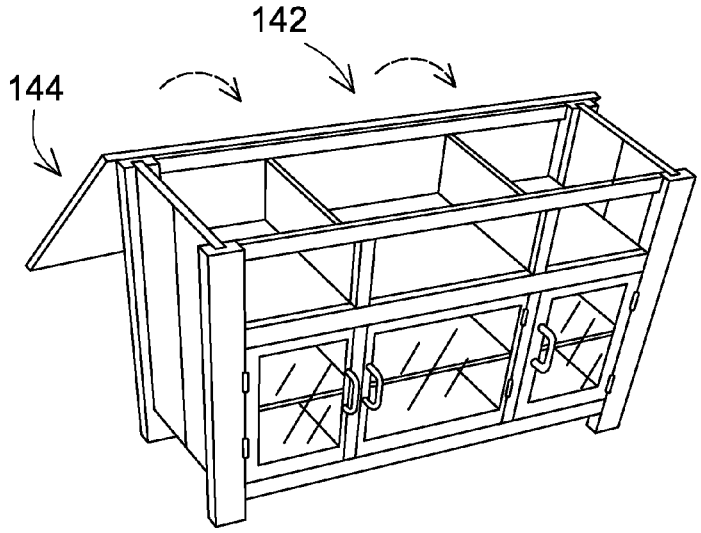
FIGS. 16A and 16B illustrate a perspective view of a hinge starting to pivot and carry the console door towards the closed position, in accordance with an embodiment of the present invention.
Figure 16B:
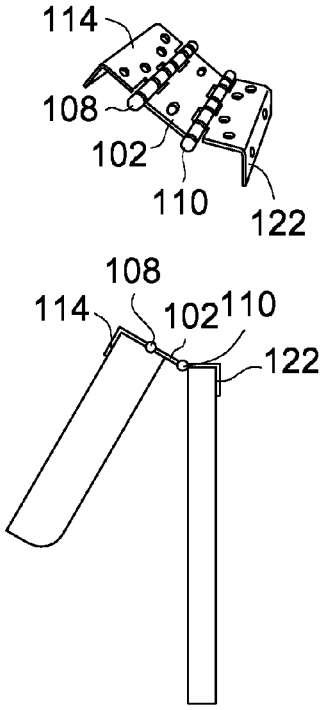
Figure 17A:
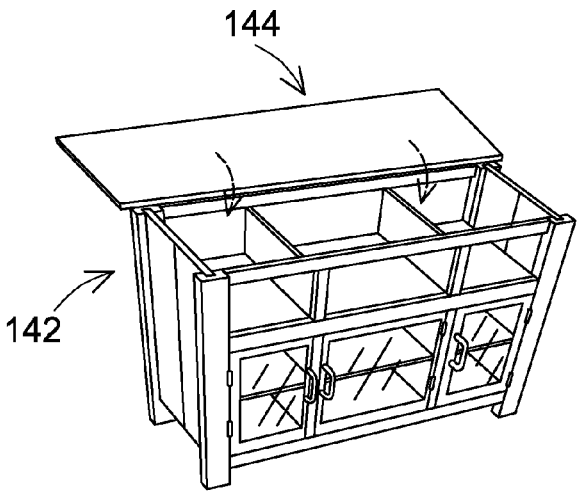
FIGS. 17A and 17B illustrate a perspective view of a hinge carrying the console door to an upright position, with the central panel being restricted from further pivoting by the at least one tab extending from the second pivoting axis, in accordance with an embodiment of the present invention.
Figure 17B:
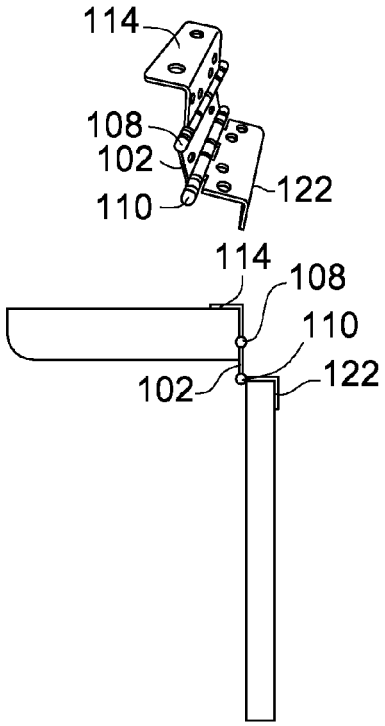
Figure 18A:
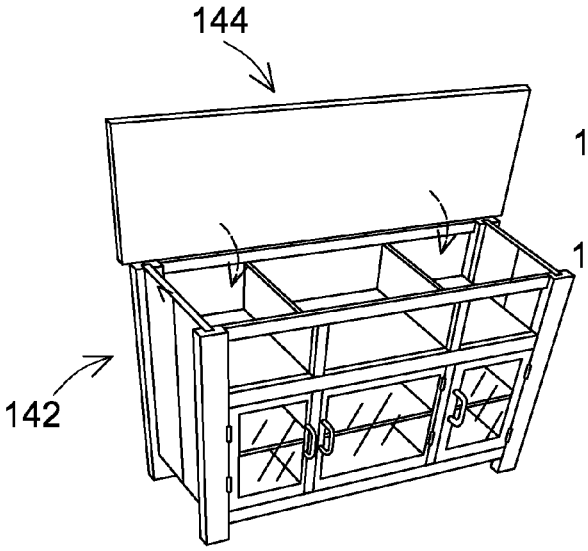
FIGS. 18A and 18B illustrate a perspective view of a hinge carrying the console door towards the closed position, in accordance with an embodiment of the present invention.
Figure 18B:
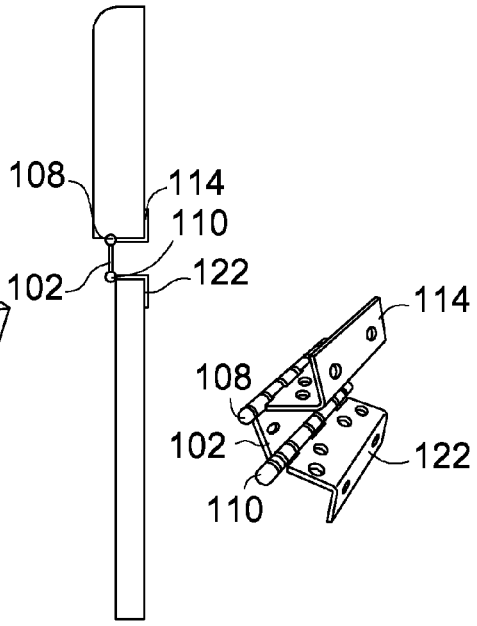

FIGS. 16A and 16B illustrate the hinge 100 starting to pivot and carry the console door 144 towards the closed position. The first L-shaped bracket 114 and the central panel 102 pivot towards the second L-shaped bracket 122. FIGS. 17A and 17B illustrate the hinge 100 carrying the console door 144 to an upright position, with the central panel 102 being restricted from further pivoting by the at least one tab 112*a*, 112*b* extending from the second pivoting axis 110. Though, it is significant to note that a tab 112*a* is not always necessary to maintain the central panel 102 at a 90° position relative to the first or second L-shaped brackets 114, 122. FIGS. 18A and 18B illustrate the hinge 100 carrying the console door 144 towards the closed position, with the first L-shaped bracket 114 continues to pivot towards the second L-shaped bracket 122, despite the pivoting restriction of the central panel 102.

Figure 19A:
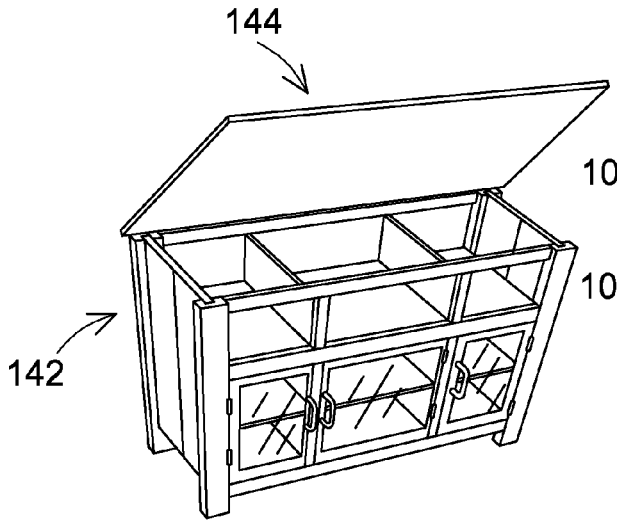
FIGS. 19A and 19B a perspective view of a hinge carrying the console door further towards the closed position, in accordance with an embodiment of the present invention.
Figure 19B:
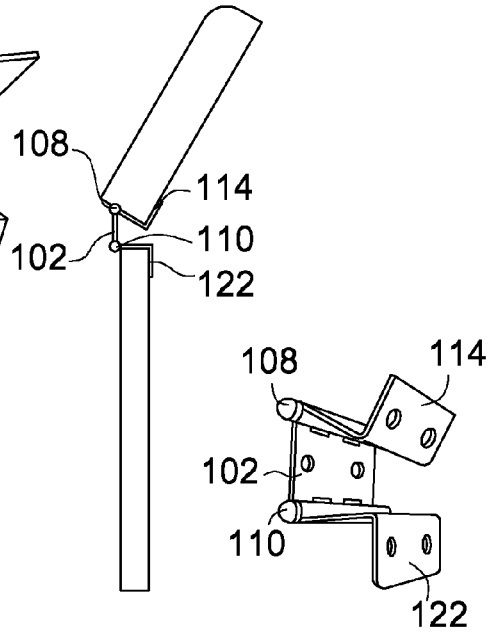
Figure 20A:
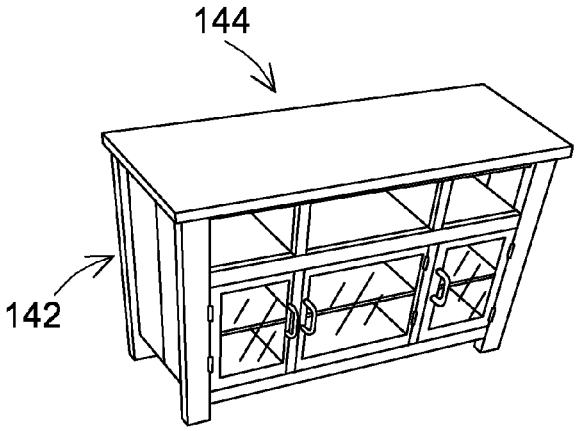
FIGS. 20A and 20B illustrate a perspective view of a hinge fully folded and the console door in the fully closed position over the console opening, in accordance with an embodiment of the present invention.
Figure 20B:
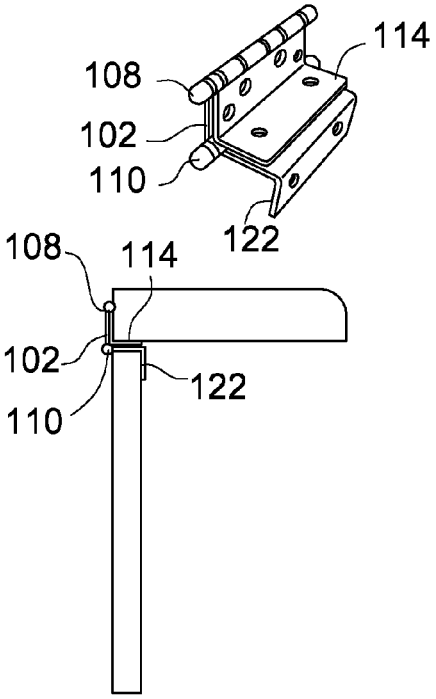

Continuing with FIGS. 19A and 19B the hinge 100 carries the console door 144 further towards the closed position, with the first L-shaped bracket 114 pivoting towards the second L-shaped bracket 122, despite the restricted pivoting of the central panel 102. FIGS. 20A and 20B illustrate the hinge 100 fully folded and the console door 144 in the fully closed position over the opening in the console 142. Here, the first mounting panel 118 of the first L-shaped bracket 114 is coplanar with the second hinging panel 124 of the second L-shaped bracket 122.

Figure 21A:
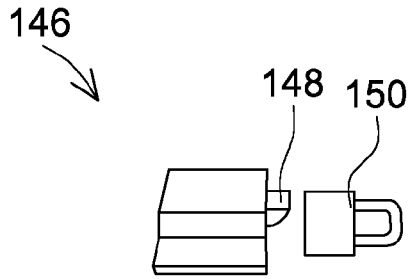
FIGS. 21A and 21B illustrate perspective views of a buckle assembly used to lock the console door, where
Figure 21B:
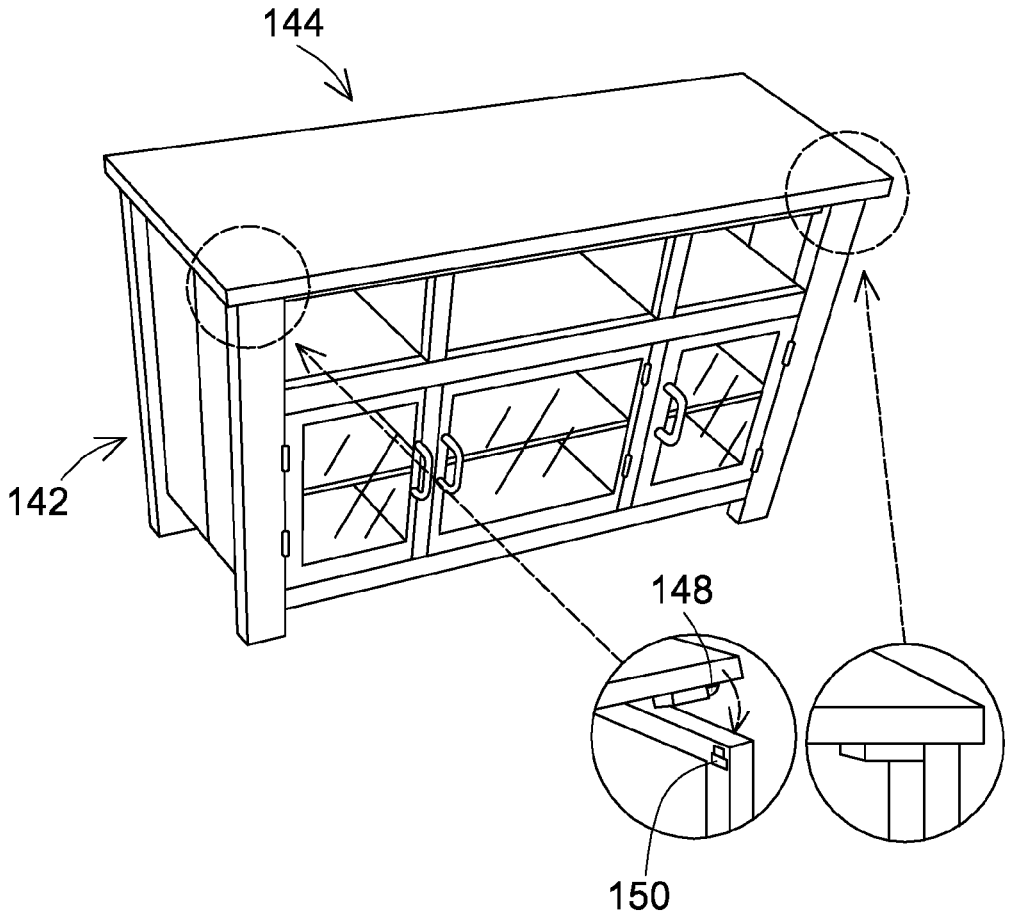

In another alternative embodiment shown in FIG. 21A, a buckle assembly 146 may be used to lock the console door 144 in the fully closed position over the console 142. FIG. 21B illustrates two buckle assemblies at the corners of the console door 144. The buckle assembly 146 may be defined by a tongue 148 and a catch 150 that work together to fasten the console door 144 in a closed position. The tongue 148 may utilize a spring action to bias the tongue 148 into the catch 150, and in an extended position for locking the console door 144, until a force is applied to release the tongue 148.

In conclusion, a double axial hinge 100 creates myriad combinations of folding, opening, closing, and extending of doors, panels, and windows of a console. The hinge 100 provides a fixed central panel 102 having a pair of edges 104*a*, 104*b*. A first pivoting axis 108 and a second pivoting axis 110 are disposed in a parallel, spaced-apart relationship, so as to enable pivoting about the central panel 102 up to 360° from two directions.

The ends of the hinge 100 utilize a first L-shaped bracket 114 and a second L-shaped bracket 122 that pivot independently of each other and have a broad L-shaped mounting panel 118, 126 that can be mounted on various mounting surfaces. The mounting panels 118, 126 of the L-shaped brackets 114, 122 can mount to the console. The L-shaped brackets 114, 122 further include a hinging panel 116, 124 that pivot about their respective pivoting axes 108, 110. In an alternative embodiment of the hinge 100, at least one tab 112*a*, 112*b* extends from the second pivoting axis 110 to restrict the central panel 102 from pivoting in a first direction beyond 90°.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A double axial hinge, comprising:

a central panel defined by a first edge and a second edge;

a first pivoting axle configured to join with the first edge of the central panel;

a second pivoting axle configured to join with the second edge of the central panel;

a first L-shaped bracket defined by a first hinging panel and a first, mounting panel, the first hinging panel and the first mounting panel are disposed in a generally perpendicular relationship, the first hinging panel configured to join with the first pivoting axle, whereby the first L-shaped bracket is configured to pivot up to 180 degrees of rotation relative to the central panel; and a second L-shaped bracket defined by a second hinging panel and a second mounting panel, the second hinging panel and the second mounting panel are disposed in a generally perpendicular relationship, the second hinging panel configured to join with the second pivoting axle, whereby the second L-shaped bracket is configured to pivot up to 90 degrees of rotation relative to the central panel, wherein the first mounting panel and the second mounting panel orient in a same direction when the first hinging panel and the second hinging panel are coplanar, wherein the central panel comprises a first plate and a second plate, the first plate is coupled to the second plate, wherein the first edge constitutes one edge of the first plate, the second edge constitutes one edge of the second plate.

2. The double axial hinge of claim 1, further including:

at least one tab coupled to the central panel, the at least one tab is configured to restrict pivoting of the central panel to 90 degrees while pivoting in a first direction towards the second L-shaped bracket, whereby when the central panel pivots 90 degrees towards the second L-shaped bracket, the at least one tab engages the second hinging panel.

3. The double axial hinge of claim 1, wherein the first hinging panel and/or the first mounting panel comprise at least one first aperture.

4. The double axial hinge of claim 1, wherein the second hinging panel and/or the second mounting panel comprise at least one second aperture.

5. The double axial hinge of claim 1, wherein the first L-shaped bracket comprises a first hinge interlock, the first hinge interlock is coupled to the first edge via the first pivoting axle.

6. The double axial hinge of claim 1. wherein the second L-shaped bracket comprises a second hinge interlock, the second hinge interlock is coupled to the second edge via the second pivoting axle.

7. The double axial hinge of claim 1, wherein the first plate comprises a first aperture and the second plate comprises a second aperture, the first plate and the second plate are fixed together by passing a fastener through the first aperture and the second aperture.

8. A double axial hinge, comprising:

a central panel defined by a first edge and a second edge;

a first pivoting axle configured to join with the first edge of the central panel;

a second pivoting axle configured to join with the second edge of the central panel;

a first L-shaped bracket defined by a first hinging panel and a first mounting panel, the first hinging panel and the first mounting panel are disposed in a generally perpendicular relationship, the first hinging panel configured to join with the first pivoting axle, whereby the first L-shaped bracket is configured to pivot up to 180 degrees of rotation relative to the central panel;

a second L-shaped bracket defined by a second hinging panel and a second mounting panel, the second hinging panel and the second mounting panel are disposed in a generally perpendicular relationship, the second hinging panel configured, to join with the second pivoting axle, whereby the second L-shaped bracket is configured to pivot up to 90 degrees of rotation relative to the central panel, wherein the first mounting panel and the second mounting panel orient in a same direction when the first hinging panel and the second hinging panel are coplanar; and at least one tab coupled to the central panel, the at least one tab is configured to restrict pivoting of the central panel to 90 degrees while pivoting in a first direction towards the second L-shaped bracket, wherein the central panel comprises a first plate and a second plate, the first plate is coupled to the second plate, wherein the first edge constitutes one edge of the first plate, the second edge constitutes one edge of the second plate.

9. The double axial hinge of claim 8, wherein the at least one tab comprises two spaced-apart tabs.

10. The double axial hinge of claim 8, wherein the first hinging panel and/or the first mounting panel comprise at least one first aperture.

11. The double axial hinge of claim 8, wherein the second hinging panel and/or the second mounting, panel comprise at least one second aperture.

12. The double axial hinge of claim 8, wherein the first L-shaped bracket comprises a first hinge interlock, the first hinge interlock is coupled to the first edge via the first pivoting axle.

13. The double axial hinge of claim 8, wherein the second L-shaped bracket comprises a second hinge interlock, the second hinge interlock is coupled to the second edge via the second pivoting axle.

14. The double axial hinge of claim 8, wherein the first plate comprises a first aperture and the second plate comprises a second aperture, the first plate and the second plate are fixed together by passing a fastener through the first aperture and the second aperture.

* * * * *